US005135212A

United States Patent [19]

Utsumi et al.

[11] Patent Number: 5,135,212

[45] Date of Patent: Aug. 4, 1992

[54] METHOD OF AND APPARATUS FOR OPTIMIZING TRANSFERENCE OF SUPPLEMENTARY PAPER MONEY IN AUTOMATIC TELLER MACHINE BY MONITORING THE PAPER MONEY PROCESSING OPERATION

[75] Inventors: Itsunori Utsumi, Owariasahi; Ryozo Nakamura, Aichi; Masashi Moriyama, Nagoya, all of Japan

[73] Assignee: Hitachi, Ltd., Tokyo, Japan

[21] Appl. No.: 478,634

[22] Filed: Feb. 12, 1990

[30] Foreign Application Priority Data

Feb. 20, 1989 [JP] Japan ..... 1-038406

[51] Int. Cl.[5] ..... B65H 5/22

[52] U.S. Cl. ..... 271/3.1; 271/9; 271/265; 235/379; 209/534; 902/15; 902/36

[58] Field of Search ..... 271/3.1, 265, 3, 9; 209/534; 235/379; 902/15, 36

[56] References Cited

U.S. PATENT DOCUMENTS 4,795,889 1/1989 Matuura et al. ..... 209/534 X
4,866,254 9/1989 Okayama et al. ..... 209/534 X
5,021,639 6/1991 Hara et al. ..... 235/379

FOREIGN PATENT DOCUMENTS 62-171092 7/1987 Japan .

*Primary Examiner*—Robert P. Olszewski
*Assistant Examiner*—Boris Milef
*Attorney, Agent, or Firm*—Kenyon & Kenyon

[57] ABSTRACT

In a method of and an apparatus for transferring supplementary paper money in an automatic teller machine that includes a paper-money processing mechanism that has a plurality of transport routes formed among the paper-money that provide a path between a plurality of paper-money containers, a cassette storing a supplementary money supply and a paper-money discriminator part for transporting paper money. A plurality of changeover gates are provided at the forks of the transport routes for changing the destination of paper money, and a control part for controlling the transportation routes and the changeover gates. The method and apparatus optimize the transfer of supplementary paper-money, and a control part for controlling the transport routes and the changeover gates. The method and apparatus optimize the transfer of supplementary paper-money by checking for times in which the paper-money processing mechanism, especially the transport routes, are not in use.

8 Claims, 3 Drawing Sheets

FIG. 3

| ITEM | OPERATION (PROCESSING) | | | |
|---|---|---|---|---|
| | PAYMENT OF PAPER MONEY | RECEIPT OF PAPER MONEY | INQUIRY ON BALANCE | ENTRY OF A SUM IN BANK BOOK |
| SELECTION OF OPERATION | ① | ① | ① | ① |
| INSERTION OF BANK BOOK | | ② | | ② |
| INSERTION OF CARD | ② | | ② | |
| INPUTTING OF PASSWORD | ③ | | ③ | |
| INPUTTING OF AMOUNT OF MONEY | ④ | | | |
| INPUTTING OF PAPER MONEY | | ③ | | |
| (COUNTING OF RECEIVED PAPER MONEY) | | ◎ | | |
| CHECK ON AMOUNT OF MONEY | ⑤ | ④ | | |
| (COMMUNICATION WICK CENTER COMPUTER) | ◎ | ◎ | ◎ | ◎ |
| (PAYING OF PAPER MONEY) | ◎ | | | |
| (STORING OF PAPER MONEY) | | ◎ | | |
| RECEIPT OF MEDIUM | ⑥ | ⑤ | ④ | ③ |

○: OPERATING PORTIONS
◎: PAPER-MONEY PROCESSING MECHANISM OPERATE

METHOD OF AND APPARATUS FOR OPTIMIZING TRANSFERENCE OF SUPPLEMENTARY PAPER MONEY IN AUTOMATIC TELLER MACHINE BY MONITORING THE PAPER MONEY PROCESSING OPERATION

BACKGROUND OF THE INVENTION

The present invention relates to a method of and an apparatus for transferring supplementary paper money in an automatic teller machine, and more particularly to a method of and an apparatus for transporting supplementary paper money efficiently from the supplementary-paper-money storing part of an automatic teller machine to the paper-money containers thereof.

An automatic teller machine is disclosed in Japanese patent application JP-A-62-171,092. In this automatic teller machine, supplementary paper money is supplied to a cartridge without stopping the machine, and is sent to paper-money containers in a period when the machine is not operated. Further, an ordinary automatic teller machine performs a paper-money paying operation in the following manner. That is, it is judged that no paper money is present in paper money containers, paper money is paid directly from a cartridge for storing supplementary paper money. Thus, even in a case where customers continually utilize the machine, paper money can be taken out, without stopping the machine. In the former machine, supplementary paper money is supplied to the paper money containers in a period when the machine is not operated. Further, in the latter machine, the amount of paper money in each paper money container is checked before a paper-money paying operation is started. When it is judged that a desired amount of paper money is not present in the paper money containers, paper money is paid directly from the cartridge for storing supplementary paper money. Thus, in these machines there arises the following problem. That is, in a case where each machine is continually utilized by customers, it is difficult to find a time necessary for sending supplementary paper money from the cartridge to the paper money containers. Hence, it is impossible to forsee a time the cartridge becomes empty. Specifically, in a case where the automatic teller machine is provided with means for checking the amount of supplementary money by causing supplementary paper money to pass through a paper-money discriminating part, there arises another problem. That is, it is impossible to foresee how long is a time necessary for checking the amount of supplementary money stored in the cartridge.

SUMMARY OF THE INVENTION

The present invention provides a solution to the above problems, that is, it provides a method of and an apparatus for transferring supplementary paper money in an automatic teller machine, in which method and apparatus supplementary paper money can be transferred to paper money containers without stopping the automatic teller machine and without exerting any adverse effect on the utilization of the machine by customers, and moreover the amount of supplementary money can be checked in a short time even when the automatic teller machine is continually utilized by customers.

A method of and an apparatus for transferring paper money in accordance with the present invention are applied to an automatic teller machine which includes a paper-money receiving/paying part for receiving and paying paper money, a plurality of paper money containers corresponding to a plurality of kinds of paper money used, storage means for storing therein supplementary paper money supplied to the paper money containers, a paper-money discriminating part for determining the kind of each of received paper money, paper money to be paid and the supplementary paper money stored in the storage means, and for checking whether or not each paper money is normal, a plurality of transport routes formed among the paper-money receiving-/paying part, the paper money containers, the storage means and the paper-money discriminating part for transporting paper money, a plurality of changeover gates provided at the forks of the transport routes for changing the destination of paper money, a control part for controlling the transport routes and the changeover gates, an operation part for inputting thereto data necessary for a desired operation, and a control unit for controlling the above elements. In the above method and apparatus, it is checked whether or not paper money is now being transported on the transport routes. When it is judged that no paper money is present on the transport routes, supplementary paper money is sent from the storage means to the paper money containers.

As mentioned above, according to the present invention, it is checked whether or not paper money is now being transported on the transport routes, and supplementary paper money is sent from the storage means to the paper money containers only when it is judged that no paper money is present on the transport routes.

A case where no paper money is present on the transport routes, will be explained below in detail. In a case where no customer operates the automatic teller machine, paper money is not transported through the transport routes, that is, no paper money is present on the transport routes. Hence, supplementary paper money can be sent from the storage means to the paper money containers.

Further, in a case where the automatic teller machine carries out a desired operation without using the transport routes, for example, in a case where the entry of a sum in a bank book or the inquiry on balance is carried out, no paper money is transported through the transport routes. Hence, supplementary paper money can be sent from the storage means to the paper money containers during those operations.

Even in a case where the automatic teller machine performs an operation necessitating the transport of paper money, supplementary paper money can be sent from the storage means to the paper money containers in a period when no paper money is transported through the transport routes, that is in a period when a user inserts a card into the machine, a password is inputted to the machine, or the machine is in communication with a center computer.

Further, in a period when paper money is taken out from and inserted into the paper-money receiving/paying port by a user, no paper money is transported through the transport routes, and hence supplementary paper money can be sent from the storage means to the paper money containers during that period.

BRIEF DESCRIPTION OF THE DRAWINGS

FIG. 3 is a table showing main operations which can be performed by the embodiment of FIG. 1.

DETAILED DESCRIPTION

The present invention will be explained below in more detail, on the basis of depicted embodiments.

Figure 1:
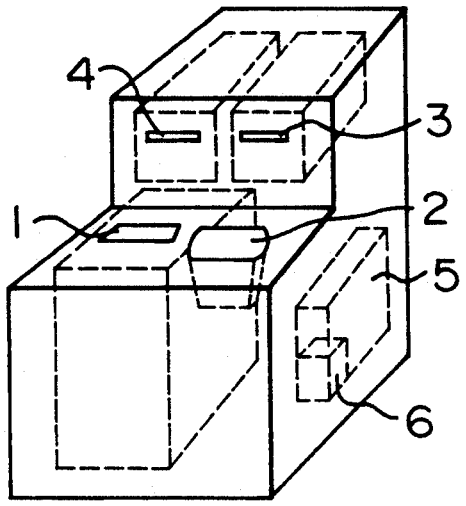
FIG. 1 is a schematic diagram showing an embodiment of an automatic teller machine, to which the present invention is applied.

FIG. 1 is a schematic diagram showing an embodiment of an automatic teller machine, to which the present invention is applied. In FIG. 1, reference numeral 1 designates a paper-money processing mechanism for performing a paper-money receiving/paying operation, 2 an operation part operated by a user, 3 a card/specification processing mechanism for reading a card and for issuing a specification (namely, minute description), 4 a bank-book processing mechanism, 5 a machine control part for controlling the whole of the automatic teller machine, and 6 a communication control part for controlling the communication between a central computer and the automatic teller machine.

Figure 2:
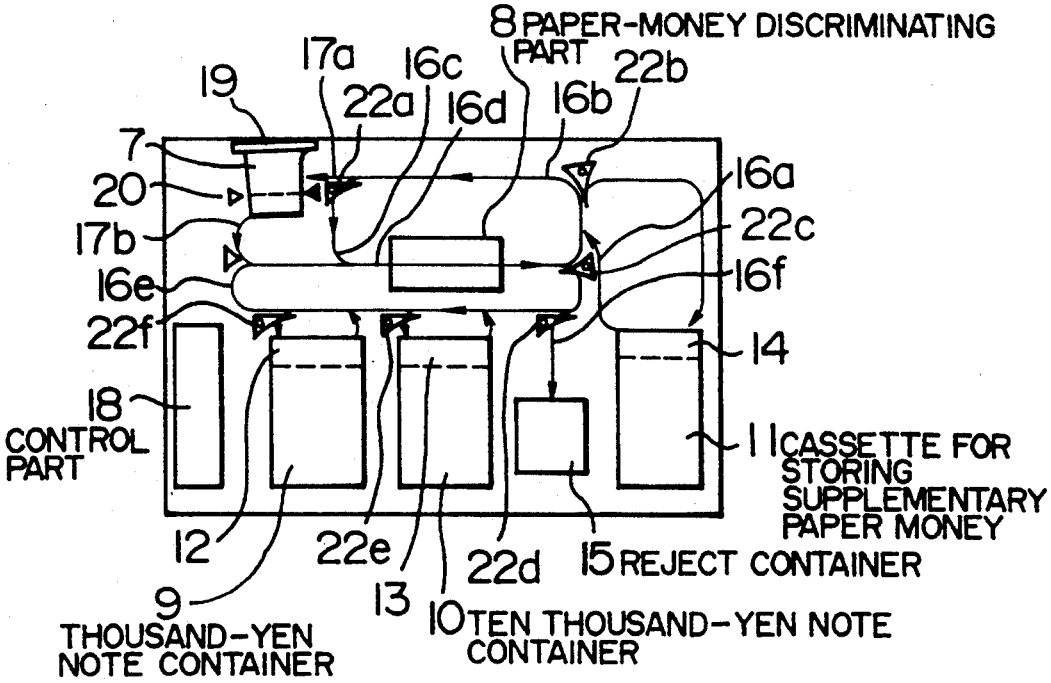
FIG. 2 is a block diagram showing an embodiment of the paper-money processing mechanism of FIG. 1.

FIG. 2 is a block diagram showing the details of an embodiment of the paper-money processing mechanism 1. In FIG. 2, reference numeral 7 designates a paper-money receiving/paying port, 8 a paper-money discriminating part, 9 a thousand-yen note container, 10 a ten thousand-yen note container, 11 a cassette for storing therein supplementary paper money which is to be supplied to the containers 9 and 10, and for storing the disused paper money sent from the containers 9 and 10, 12 to 14 paper-money piling/sending mechanisms for sending out bank notes from the containers 9 and 10 and the cassette 11 one by one, and for piling bank notes which are received one by one, and 15 a reject container. The paper money sent out from the containers 9 and 10, the disused paper money sent to the cassette 11, and supplementary paper money sent from the cassette 11 to the containers 9 and 10, are all checked by the paper-money discriminating part 8. The paper money which has been judged to be abnormal, is sent to the reject container 15, to be stored therein. Further, in FIG. 2, reference symbols **16*a* to 16*f* designate paper money transport routes formed among the paper-money piling/sending mechanism 14 of the cassette 11, the paper-money piling/sending mechanisms 12 and 13 of the containers 12 and 13, the paper-money discriminating part 8, and the reject container 15, 17*a* a transport route for transmitting paper money which is to be taken out from the paper-money receiving/paying port 7, and 17*b* a transport route for transmitting paper money which has been received by the port 7. Further, changeover gates 22*a* to 22*f* are provided at the forks of the transport routes, as shown in FIG. 2. Each of the changeover gates 22*a* to 22*f* is made up of a sector-shaped member which is rotated round a fulcrum so as to be placed at one of two predetermined positions, and electromagnetic means (not shown) for rotating the sector-shaped member. Further, reference numeral 18 in FIG. 2 designates a control part for specifying the changeover operation of each of the gates 22*a* to 22*f* and for specifying the operations of other parts. The control part 8 is controlled by the machine control part 5 of FIG. 1. The paper-money receiving/paying port 7 is provided with a shutter 19, and a sensor 20 is so disposed as to be able to detect paper money in the paper-money receiving/paying port 7**. The above-mentioned automatic teller machine is described in U.S. Pat. No. 4,795,889 and others. Accordingly, detailed explanation of the construction and operation of the above machine will be omitted.

Next, explanation will be made of the operation of the paper-money processing mechanism shown in FIG. 2. A paper-money paying operation will first be explained.

In a case where the paper-money paying operation is performed, a desired number of bank notes are sent out of the paper money containers 9 and 10 with the aid of the paper-money piling/sending mechanisms 12 and 13, and are then transported to the paper-money receiving-/paying port 7 through the transport routes **16*e* and 16*d*, the paper-money discriminating part 8, and the transport routes 16*b* and 17*a*. At this time, bank notes which are judged to be abnormal (for example, a sheet of paper different from paper money, a bank note inclined at an angle to a predetermined direction, a bank note deviated in a direction perpendicular to the predetermined direction, a folded-back bank note, two overlapping bank notes, and others) are all sent to the reject container 15 through the transport route 16*f*, to be stored in the reject container 15. When a condition for paying bank notes to a user is satisfied (for example, a card is drawn out), the shutter 19 is made open on the basis of the command from the control part 5. It is detected by the sensor 20 that the user has taken out the bank notes, and then the shutter 19** is closed. Thus, the paper-money paying operation is completed.

Next, explanation will be made of a paper-money receiving operation. In a case where the paper-money receiving operation is performed, paper money is supplied to the paper-money receiving/paying port 7, and is then sent to the paper-money discriminating part 8 through the transport routes **17*b* and 16*d*, to check the kind of the paper money. The paper money from the discriminating part 8 is sent to the paper-money piling-/sending mechanisms 12 and 13, to be stored in the containers 9 and 10**.

Next, explanation will be made of an operation for sending supplementary paper money from the cassette 11 to the containers 9 and 10. Supplementary paper money in the cassette 11 is sent out therefrom with the aid of the paper-money piling/sending mechanism 14, and is then transported to the paper-money discriminating part 8 through the transport routes **16*a*, 16*b*, 16*c* and 16*d*. The kind of the supplementary paper money is checked by the paper-money discriminating part 8. Then, the supplementary paper money is sent to the paper-money piling/sending mechanisms 12 and 13 through the transport route 16*e*, to be stored in the containers 9 and 10. At this time, supplementary paper money which is judged to be abnormal, is sent to the reject container 15, to be stored therein. Further, the total amount of supplementary money is detected by the control part 18, and the machine control part 5 sends data indicative of the total amount of supplementary money, to the central computer through the communication control part 6**.

FIG. 3 shows the procedure of each of main operations which can be performed by an automatic teller machine. Further explanation of these operations will be omitted, since the operations are well known.

Figure 4:
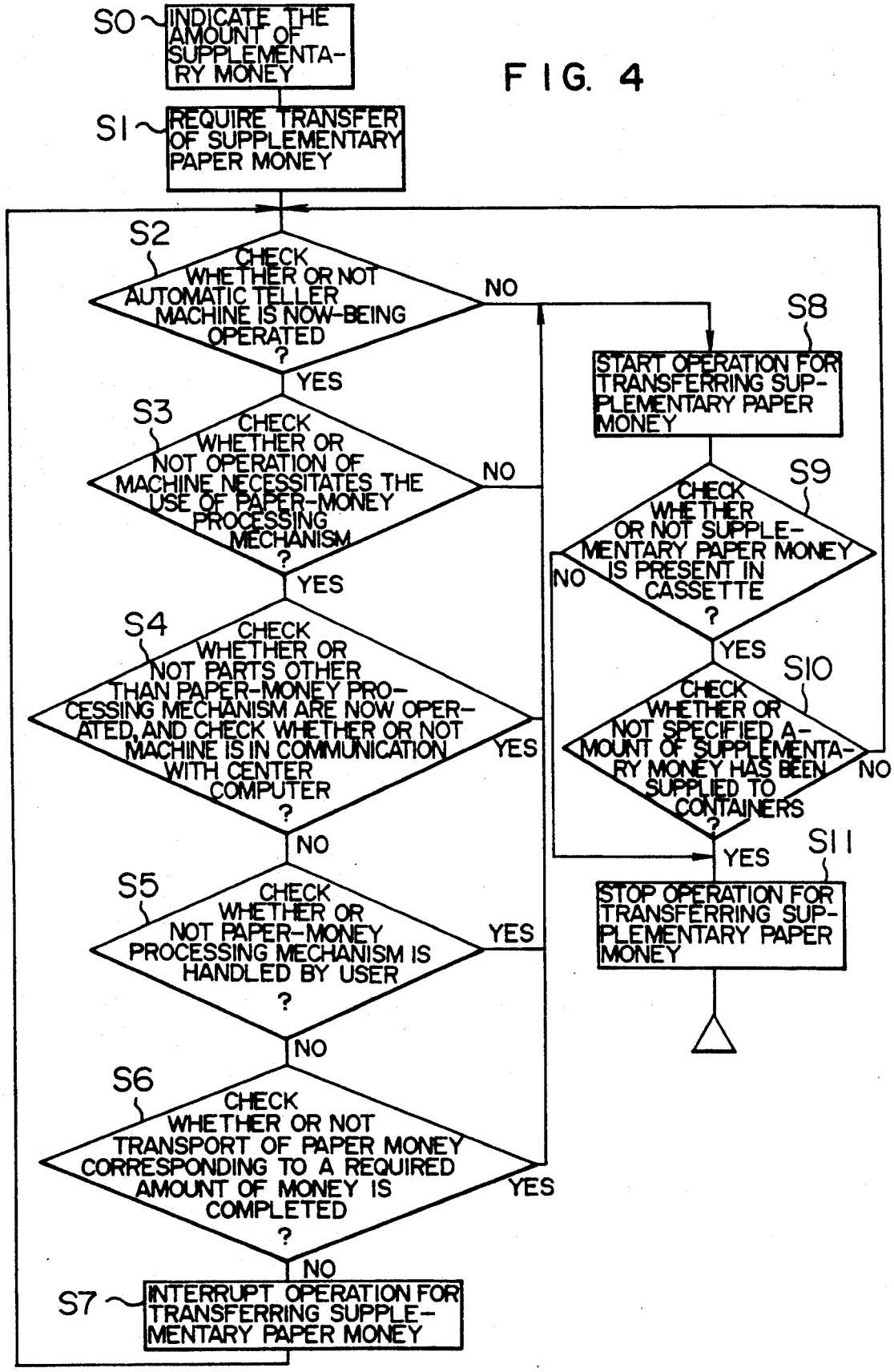
FIG. 4 is a flow chart for explaining a method of transferring supplementary paper money in accordance with the present invention.

Next, the operations of the machine control part 5 and control part 18 for transferring supplementary paper money will be explained below in detail, on the basis of the flow chart of FIG. 4.

The cassette 11 loaded with supplementary paper money is placed at a predetermined position by a clerk in charge, or a bundle of supplementary paper money is set in the cassette 11 placed at the predetermined position, and the amount of supplementary money is indicated by the clerk (step S0). Then, the clerk operates a clerk operation part which is provided on the rear side of the automatic teller machine but is not shown in FIG. 1, so as to require the transfer of the supplementary paper money (step S1). In step S2, it is checked by the machine control part whether or not the automatic teller machine is now being operated. In more detail, it is checked whether or not the automatic teller machine is operated in response to a user's operation for the operation part 2. When it is judged in the step S2 that the automatic teller machine is not operated, supplementary paper money can be transported. Hence, the processing in step S8 is carried out, that is, an operation for transferring supplementary paper money from the cassette 11 to the containers 9 and 10 is started.

When it is judged in the step S2 that the automatic teller machine is now being operated, the processing in step S3 is carried out. That is, it is checked whether or not the operation of the automatic teller machine necessitates the use of the paper-money processing mechanism 1. In other words, it is checked whether or not one of a paper-money receiving operation and a paper-money paying operation is performed. In a case where it is judged in the step S3 that the operation of the automatic teller machine does not necessitate the use of the paper-money processing mechanism 1, for example, in a case where the entry of a sum in a bank book is carried out, the supplementary paper money can be transported. Hence, the processing of step S8 is carried out, that is, the operation for transferring supplementary paper money is started.

In a case where it is judged in the step S3 that the operation of the automatic teller machine necessitates the use of the paper-money processing mechanism 1, the processing in step S4 is carried out. That is, it is checked whether or not parts of the automatic teller machine other than the paper-money processing mechanism 1 are now being operated, and it is checked whether or not the automatic teller machine is in communication with the central computer. The operations of the parts other than the paper-money processing mechanism 1 include various items of FIG. 3 other than the inputting of paper money, the counting operation of received paper money, the check on amount of money, the paper money paying operation, the paper money storing operation and the receipt of a medium. For example, the insertion of a card into the card/specification processing mechanism 3, the withdrawal of the card therefrom, the insertion of a bank book into the bank-book processing mechanism 4 and the withdrawal of the bank book therefrom are included in the operations of the parts other than the paper-money processing mechanism 1. When it is judged that the parts other than the paper-money processing mechanism 1 are now being operated or it is judged that the automatic teller machine is in communication with the central computer, supplementary paper money can be transported. Thus, the processing in the step S8 is carried out, that is, the operation for transferring supplementary paper money is started.

When it is judged in the step S4 that the paper-money processing mechanism 1 is operated and the automatic teller machine does not communicate with the central computer, the processing in step S5 is carried out. That is, it is checked whether or not the paper-money processing mechanism 1 is now being handled by the user. In more detail, it is checked whether or not one of the inputting of paper money and the receipt of a medium each shown in FIG. 3 is now being carried out. That is, the handling of the paper-money processing mechanism 1 by the user includes the opening of the shutter 19 for inserting paper money into the paper-money receiving-/paying port 7 in the paper-money receiving operation and the opening of the shutter 19 for taking out paper money from the paper-money receiving/paying port 7 in the paper-money paying operation. The presence or absence of paper money in the port 7 is detected by the sensor 20. When it is judged in the step S5 that the paper-money processing mechanism 1 is handled by the user, the supplementary paper money can be transported. Thus, the processing in the step S8 is carried out, tht is, the operation for transferring supplementary paper money is started.

When it is judged in the step S5 that the paper-money processing mechanism 1 is not handled by the user, the processing in step S6 is carried out, that is, it is checked whether or not the transport of paper money is completed. When bank notes corresponding to a required amount of money are all sent from the containers 9 and 10 to the paper-money receiving/paying port 7, or when bank notes inputted to the paper-money receiving/paying port 7 are all sent to the containers 9 and 10, the transport of paper money is completed. When the transport of paper money is completed, no paper money is present on the transport routes 16*a* to 16*f*, 17*a* and 17*b*. The absence of paper money on the above transport routes can be confirmed in such a manner that the control part 18 checks whether or not the amount of transported money agrees with the amount of money outputted from the containers 9 and 10 or the paper-money receiving/paying port 7. When it is judged in the step S6 that the transport of paper money is completed, supplementary paper money can be transported. Thus, the processing in the step S8 is carried out, that is, the operation for transferring supplementary paper money is started.

When it is judged in the step S6 that the transport of paper money corresponding to a required amount of money is not yet completed, the processing in step S7 is carried out, that is, the operation for transferring supplementary paper money is interrupted.

When the operation for transferring supplementary paper money is started in the step S8, it is checked whether or not supplementary paper money is present in the cassette 11 (step S9). When it is judged in the step S9 that no paper money is present in the cassette 11, the processing in step S11 is carried out, that is, the operation for transferring supplementary paper money is stopped. When it is judged in the step S9 that supplementary paper money is present in the cassette 11, the processing in step S10 is carried out, that is, it is checked whether or not a specified amount of supplementary money has been supplied to the containers 9 and 10. When it is judged in the step S10 that the specified amount of supplementary money has not been supplied to the containers 9 and 10, the processing in the steps S2 to S6, S8, S9 and S10 is repeated. When it is judged in the step S10 that the specified amount of supplementary money has been supplied to the containers 9 and 10, the operation for transferring supplementary paper money is terminated in the step S11. Incidentally, one of the steps S9 and S10 may be omitted.

When the operation for transferring supplementary paper money is completed, the amount of supplementary money is confirmed by the automatic teller machine, though a confirmation part is not shown in FIG. 1. Then, a specification (namely, minute description) is delivered from the card/specification processing mechanism 3 to the rear side of the automatic teller machine. Thus, the amount of supplementary money which does not include rejected paper money, can be confirmed.

In a case where the reject container 15 is divided into two parts so that the rejected paper money in the paper-money receiving and paying operations is stored in one of the above parts and the rejected supplementary paper money is stored in the other part, when the clerk in charge takes out the rejected supplementary paper money from the other part, the amount of money on the specification quite agrees with the amount of supplementary money which has been received by the automatic teller machine.

Further, in a case where the reject container 15 is separated into two parts so that the rejected paper money in the paper-money receiving and paying operations is stored in one of the above parts and the rejected supplementary paper money is stored in the other part, and the other part and the cassette 11 are incorporated in one to obtain a united cassette, the rejected supplementary paper money is stored in the united cassette. Accordingly, when the united cassette is set in the automatic teller machine for the purpose of supplying supplementary paper money to the paper-money containers, and the united cassette is taken out from the automatic teller machine after the supplementary paper money has been transported to the paper-money containers, supplementary paper money corresponding to the amount of money on the specification is supplied to the automatic teller machine. Further, in a case where supplementary paper money is supplied to a plurality of automatic teller machines, it is not always required to use a plurality of cassettes, but the automatic teller machines can be successively supplied with supplementary paper money from a single united cassette.

As has been explained in the foregoing, according to the present invention, supplementary paper money is supplied to the paper money containers of an automatic teller machine in a period when the automatic teller machine is not operated, or the automatic teller machine is operated without using the paper-money transport routes of the paper-money processing mechanism. Hence, the supplementary paper money can be supplied to the paper money containers without stopping the operation of the automatic teller machine, and without exerting any adverse effect on the utilization of the automatic teller machine by users. Accordingly, even in a case where the automatic teller machine is continually utilized by users, the supplementary paper money can be supplied to the paper money containers in a short time.

What is claimed is:

1. A method of transferring supplementary paper money in an automatic teller machine that includes a paper-money processing mechanism including a paper-money receiving/paying part adapted to receive and pay paper money, a plurality of paper-money containers corresponding to a plurality of kinds of paper money used, means for storing therein supplementary paper money which is to be supplied to the paper-money containers, a paper-money discriminator adapted to determine the kind of each of received paper money, paper money to be paid and the supplementary paper money stored in the means for storing, and for checking whether or not each paper money is normal, a plurality of transport routes formed among the paper-money receiving/paring part, the paper-money containers, the means for storing and the paper-money discriminator, a plurality of changeover gates provided at the forks of the transport routes, said gates provided for changing the destination of paper money, and a controller provided for controlling the transport routes and the changeover gates; an operation part for inputting thereto data necessary for a desired operation; and a control unit provided for controlling the paper-money processing mechanism and the operation part, the method comprising steps of:

first checking whether or not operation of the paper money processing mechanism is being required while the automatic teller machine is in use by a user; and transporting the supplementary paper money from the means for storing to the paper-money containers, when it is judged that the operation of the paper-money processing mechanism is not required.

2. A method according to claim 1, further comprising steps of:

after determining that the operation of the paper-money processing mechanism is required, checking whether or not the operation of the paper-money processing mechanism is now being performed; and transporting the supplementary paper money from the means for storing to the paper-money containers, when it is judged that the operation of the paper-money processing mechanism is not being performed.

3. A method according to claim 2, further comprising steps of:

after determining that the operation of the paper-money processing mechanism is being performed checking whether or not paper money is now being transported on the transport routes; and transporting the supplementary paper money from the means for storing to the paper-money containers, when it is judged that no paper money is present on the transport routes.

4. An apparatus for transferring supplementary paper money in an automatic teller machine, comprising:

a paper-money processing mechanism including, a paper-money receiving/paying part adapted to receive and pay paper money, a plurality of paper-money containers corresponding to a plurality of kinds of paper money used, means for storing therein supplementary paper money which is to be supplied to the paper-money containers, a paper-money discriminator adapted to determine the kind of each of received paper money, paper money to be paid and the supplementary paper money stored in the means for storing, and for checking whether or not each paper money is normal, a plurality of transport routes formed among the paper-money receiving/paying part, the paper-money containers, the means for storing and the paper-money discriminator for transporting paper money, a plurality of changeover gates provided at the forks of the transport routes and adapted to change the destination of paper money, and a controller controlling the transport routes and the changeover gates;

means for inputting thereto data necessary for a desired operation;

a control unit provided for controlling the paper-money processing mechanism and the means for inputting;

means for checking during use of the automatic teller by a user, whether or not operation of the paper-money processing mechanism is being required; and means for transporting the supplementary paper money from the means for storing to the paper-money containers, when it is judged that the operation of the paper-money processing mechanism is not required.

5. An apparatus according to claim 4, further comprising:

means for checking whether or not the operation of the paper-money processing mechanism is now being performed, when it is judged that the operation of the paper-money processing mechanism is required; and means for transporting the supplementary paper money from the means for storing to the paper money containers, when it is judged that the operation of the paper-money processing mechanism is not being performed.

6. An apparatus according to claim 5, further comprising:

means for checking whether or not paper money is now being transported on the transport routes, when it is judged that the operation of the paper-money processing mechanism is now being performed; and means for transporting the supplementary paper money from the storage means to the paper-money containers, when it is judged that no paper money is present on the transport routes.

7. An apparatus according to claim 4, wherein the means for checking further checks whether one of the means for storing, the paper money containers and the paper-money discriminator are operated or not.

8. An apparatus according to claim 4, wherein the means for checking further checks whether or not the transfer of paper money corresponding to a predetermined amount of money between the paper-money receiving/paying part and the paper-money containers has been completed in the course of the paper-money receiving/paying operation.

* * * * *

UNITED STATES PATENT AND TRADEMARK OFFICE

CERTIFICATE OF CORRECTION

PATENT NO. : 5,135,212

DATED : August 4, 1992

INVENTOR(S) : Itsunori Utsumi, et. al.

It is certified that error appears in the above-indentified patent and that said Letters Patent is hereby corrected as shown below:

Title page, item [57]

| Column | Line | |
|---|---|---|
| ABS. | 14 | After "money" delete entire line. |
| ABS. | 15 | Delete entire line. |
| ABS. | 16 | Delete entire line. |
| ABS. | 17 | Delete "money" (first occurrence). |
| 1 | 44 | Change "forsee" to --foresee--. |
| 2 | 57 | Change "center" to --central--. |
| 6 | 18 | Change "tht" to --that--. |
| 8 | 41 | After "performed" insert --,--. |

Signed and Sealed this

Twenty-eighth Day of September, 1993

Bruce Lehman

*Attest:*

BRUCE LEHMAN

*Attesting Officer*

*Commissioner of Patents and Trademarks*